US006282998B1

(12) United States Patent
Beach

(10) Patent No.: US 6,282,998 B1
(45) Date of Patent: Sep. 4, 2001

(54) FASTENER-DRIVING ACCESSORY FOR ROTARY DRIVING TOOL

(75) Inventor: John R. Beach, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/192,049

(22) Filed: Nov. 13, 1998

(51) Int. Cl.[7] ..... B25F 1/00
(52) U.S. Cl. ..... 81/437; 81/54; 81/177.2
(58) Field of Search ..... 81/44, 437, 177.2, 81/54

(56) References Cited

U.S. PATENT DOCUMENTS

| | | | | |
|---|---|---|---|---|
| 3,960,191 | | 6/1976 | Murray . | |
| 3,965,510 | | 6/1976 | Ernst . | |
| 4,107,800 | | 8/1978 | Jorgensen . | |
| 4,236,555 | | 12/1980 | Dewey . | |
| 4,296,656 | | 10/1981 | Ernst . | |
| 4,344,340 | * | 8/1982 | Erickson | 81/177 A |
| 4,349,929 | | 9/1982 | Dewey . | |
| 4,397,412 | | 8/1983 | Dewey . | |
| 4,803,904 | * | 2/1989 | Stanich et al. | 81/54 |
| 4,945,790 | * | 8/1990 | Golden | 81/57.14 |
| 5,168,781 | | 12/1992 | Tenuta . | |
| 5,302,068 | | 4/1994 | Janusz et al. . | |
| 5,680,800 | * | 10/1997 | Sharpe | 81/177.2 |
| 5,732,606 | * | 3/1998 | Chiang | 81/177.2 |
| 5,836,223 | * | 11/1998 | Lin | 81/436 |
| 5,921,157 | * | 7/1999 | Smith et al. | 81/58.1 |
| 5,927,161 | * | 7/1999 | Clifford et al. | 81/177.2 |

* cited by examiner

*Primary Examiner*—James G. Smith
*Assistant Examiner*—Hadi Shakeri
(74) *Attorney, Agent, or Firm*—Rockey, Milnamow & Katz, Ltd.

(57) ABSTRACT

Being useful with a rotary driving tool powered electrically or pneumatically, a fastener-driving accessory comprises a collar-mounting stem and two interchangeable collars, each being mountable coaxially and removably on the stem and being secured removably when mounted thereon. The collar-mounting stem has a collar-mounting portion having a distal end and having a polygonal cross-section. Each collar defines a stem-receiving socket, which has a similar but larger cross-section and into which the collar-mounting portion can be non-rotatably plugged. A fastener-driving collar defines a fastener-driving socket having a cross-section conforming to the cross-section of the stem-receiving socket so that the stem-receiving and fastener-driving sockets are interchangeable. A bit-mounting collar accommodates a fastener-driving bit having a socket-fitting portion, which has a polygonal cross-section conforming to the polygonal cross-section of the collar-mounting portion of the stem, and a fastener-driving portion. In one contemplated embodiment, the collar-mounting stem is connected to a tool-drivable stem, by a quill.

4 Claims, 2 Drawing Sheets

24
C
22
20
10
28
28
26
200
40
40
32
38
38
30
34
70
50
78
100

C
30

40
32
38
38
30
34
70
52
54
58
50
78
56
100

28
28
210
200
6
38
38
34
30
70
122
120
7
7
124
126
66
98
8
8
60
68
64
6

40
38
38
30
34
70
120
122
124

FASTENER-DRIVING ACCESSORY FOR ROTARY DRIVING TOOL

TECHNICAL FIELD OF THE INVENTION

This invention pertains to a fastener-driving accessory useful with a rotary driving tool, which may be electrically or pneumatically powered. Along with one stem or two stems connected by a quill, two interchangeable collars are provided, namely a fastener-driving collar and a bit-mounting collar. The fastener-driving collar can have two interchangeable sockets, either of which can serve as a fastener-driving socket. The bit-mounting collar can mount a fastener-driving bit of a type known heretofore.

BACKGROUND OF THE INVENTION

As exemplified in U.S. Pat. No. 4,236,555, it is known to equip a rotary driving tool, such as a screw gun, with a fastener-driving element, such as a socket head or a driving bit, which is carried by an elongate member, such as a rod, so as to enable the tool to be conveniently operated by a standing operator. As exemplified in U.S. Pat. Nos. 5,347,707, 5,445,297, 5,555,780, and 5,584,415, it is known to equip a roofing washer-dispensing and fastener-driving machine with a similarly equipped rotary driving tool.

This invention addresses a recognized need for an improved means for interchanging fastener-driving elements, such as socket heads and driving bits, in a rotary power tool, which may be electrically or pneumatically powered, particularly but not exclusively in a rotary power tool equipped with a fastener-driving element carried by an elongate member, as discussed above.

SUMMARY OF THE INVENTION

This invention addresses the aforementioned need by providing a fastener-driving accessory useful with a rotary power tool, which may be electrically, or pneumatically powered. In its simplest embodiments, the fastener-driving accessory comprises a collar-driving stem and a collar, either a fastener-driving collar or a bit-mounting collar. In one contemplated embodiment, the collar-driving stem is connected to a tool-drivable stem, by a quill.

The collar-driving stem defines an axis and has a collar-mounting portion having a polygonal cross-section. It is preferred that the collar-mounting portion has a hexagonal cross-section. Each of the fastener-driving and bit-mounting collars defines an axis.

The fastener-driving collar defines two axially aligned sockets, each having a polygonal cross-section, which is similar to but larger than the polygonal cross-section of the collar-mounting portion. The axially aligned sockets are interchangeable to serve respectively as a stem-receiving socket and as a fastener-driving socket.

The collar-mounting portion of the collar-driving stem is adapted to be non-rotatably plugged into whichever socket serves as the stem-receiving socket so as to mount the fastener-driving collar coaxially on the collar-driving stem.

Preferably, the fastener-driving collar has two opposite ends and one continuous passage defining the axially aligned sockets, extending between the opposite ends, and having a polygonal cross-section conforming to the polygonal cross-sections of the axially aligned sockets. Preferably, moreover, the collar-mounting portion of the collar-driving stem is adapted to be non-rotatably plugged more than half way through the continuous passage when plugged into either of the axially aligned sockets so as to protect the polygonal cross-section of an intermediate portion of the fastener-driving collar against wearing as either of the axially aligned sockets wears.

The bit-mounting collar has two opposite ends, namely a stem-receiving end and a bit-mounting end, the bit-mounting collar defines a stem-receiving socket opening at the stem-receiving end and having a polygonal cross-section, which is similar to but larger than the polygonal cross-section of the collar-mounting portion of the collar-driving stem. The bit-mounting collar has an axial passage extending between the bit-mounting end and the stem-receiving socket of the bit-mounting collar and having a circular cross-section with a cross-sectional area smaller than the cross-sectional area of the polygonal cross-section of the stem-receiving socket of the bit-mounting collar. The stem-receiving socket of the bit-mounting collar has sufficient axial length for the distal end of the collar-mounting portion of the collar-driving stem to be axially spaced from the axial passage when plugged into the stem-receiving socket.

The fastener-driving collar is designed to accommodate a fastener-driving bit of a type known heretofore. The polygonal cross-section of the socket-fitting portion of the fastener-driving bit conforms to the polygonal cross-section of the collar-mounting portion of the collar-driving stem. The fastener-driving portion, which has a fastener-driving tip, has an axial length longer than the axial length of the axial passage and has cross-sectional shapes adapting the fastener-driving portion to extend through the axial passage.

The fastener-driving bit is mountable to the bit-mounting collar with the socket-fitting portion fitting within the stem-receiving socket of the bit-mounting collar, between the collar-mounting portion and the axial passage, with the fastener-driving portion extending through the axial passage, and with the fastener-driving tip projecting axially from the bit-mounting collar.

The fastener-driving and bit-mounting collars are interchangeable. Means are provided for securing whichever collar is used removably on the collar-driving stem when the collar-mounting portion is plugged into whichever socket serves as the stem-receiving socket.

These and other objects, features, and advantages of this invention are evident from the following description of a preferred embodiment of this invention, with reference to the accompanying drawings.

DETAILED DESCRIPTION OF PREFERRED EMBODIMENT

Figure 1:
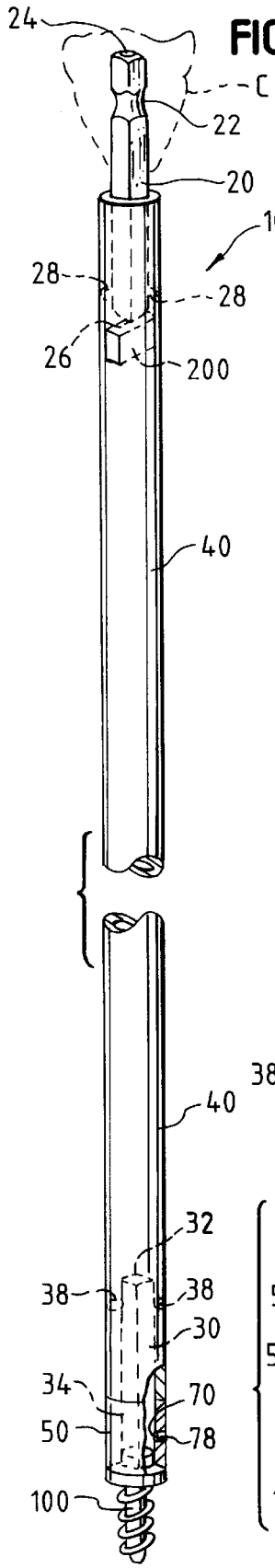
FIG. 1 is a fragmentary, perspective view of a fastener-driving accessory constituting a preferred embodiment of this invention and comprising a fastener-driving collar, as used to drive a fastener, which is shown.

As shown in the drawings, a fastener-driving accessory 10 constituting a preferred embodiment of this invention is useful with a rotary driving tool, either electrically powered or pneumatically powered, which is not shown except for a chuck C shown in broken lines. Broadly, the fastener-driving accessory 10 comprises a tool-drivable stem 20, a collar-mounting stem 30, a tubular quill 40 connecting the respective stems 20, 30, and two interchangeable collars, namely a fastener-driving collar 50 adapted to drive a fastener of a known type, such as a hex-head fastener 100, and a bit-mounting collar 60 adapted to mount a fastener-driving bit of a known type, such as a fastener-driving bit 120 adapted to drive Phillips-head fasteners (not shown).

The fastener-driving accessory 10 can be advantageously employed in a rotary driving tool, such as a screw gun, which is adapted to be conveniently operated by a standing operator, as exemplified in U.S. Pat. No. 4,236,555, the disclosure of which is incorporated herein by reference. The fastener-driving accessory 10 also can be advantageously employed in a roofing washer-dispensing and fastener-driving machine, as exemplified in U.S. Pat. Nos. 5,445,297, 5,555,780, and 5,584,415, the disclosures of which are incorporated herein by reference.

Being elongate and defining an axis, the tool-drivable stem 20 has a hexagonal cross-section, except for a circumferential recess 22 near one end 24 of the stem 20, and except for a hole or holes to be later described. The circumferential recess 22 enables the stem 20 to coact with a known detent (not shown) in the tool chuck C when the same end 24 of the stem 20 is plugged partly into the tool chuck C. The other end 26 of the stem 20 is plugged partly into one end of the tubular quill 40. So as to cause the stem 20 and the quill 40 to be conjointly rotatable, the stem 20 is secured to the quill 40 by a roll pin 28 driven through a suitably sized hole in the quill 40, through a suitably sized cross-bore in the stem 20, and through a suitably sized, diametrically opposed hole in the quill 40.

Figure 5:
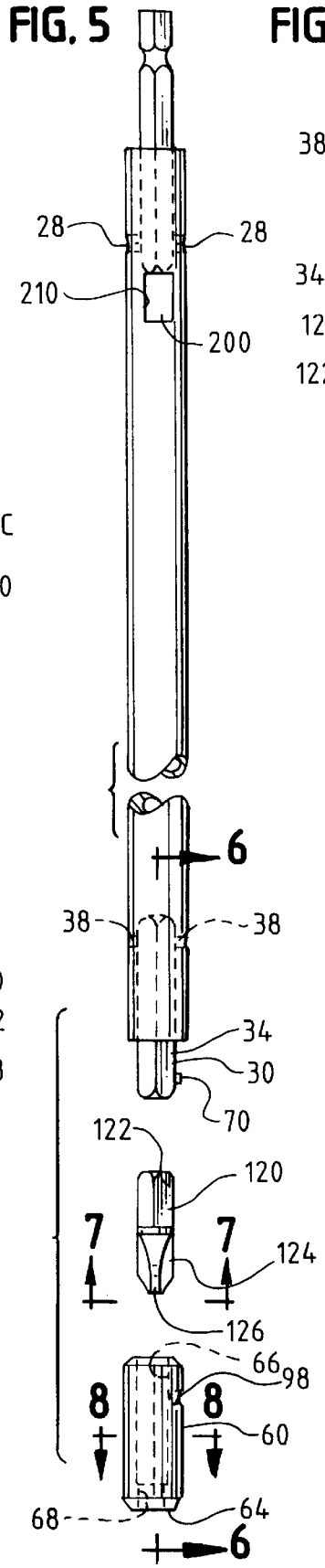
FIG. 5 is an exploded view of certain elements of the fastener-driving accessory, as shown in FIG. 4.

As shown in FIGS. 1 and 5, a dowel 200 having a rectangular cross-section providing the dowel 200 with two flat faces, namely an upper face 202 and a lower face 204, is mounted across the tubular quill 40, so as to extend through aligned rectangular apertures 210 in the tubular quill 40, and is positioned so that the stem end 26 bears against the upper face 202 when an axial load is applied that tends to press the tool-drivable stem 20 further into the tubular quill 40. Moreover, the diametrically opposed holes provided in the tubular quill 40 for the roll pin 28 are oversized, as compared to the roll pin 28. Accordingly, when such a load is applied, the roll pin 38 is not stressed by the applied load and tendencies of the roll pin 38 to break are reduced.

Being elongate and defining an axis, the collar-mounting stem 30 has an essentially identical, hexagonal cross-section. One end 32 of the stem 30 is plugged partly into the other end of the tubular quill 40, with a sliding fit, and a collar-mounting portion 34 including the other end 36 of the stem 30 projects from the quill 40. So as to cause the stem 30 and the quill 40 to be conjointly rotatable, the stem 40 is secured to the quill 40 by a roll pin 38 driven through a suitably sized hole in the quill 40, through a suitably sized cross-bore in the stem 20, and through a suitably sized, diametrically opposed hole in the quill 40. The collar-mounting portion 34 of the stem 30 projects from the quill 40 and is used to mount a selected one of the interchangeable collars.

Figure 3:
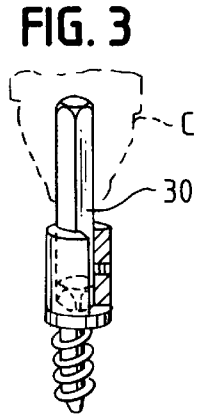
FIG. 3 is a fragmentary, perspective view of a fastener-driving accessory constituting a simplified embodiment of this invention and comprising a fastener-driving collar, as used to drive a fastener, which is shown.
Figure 2:
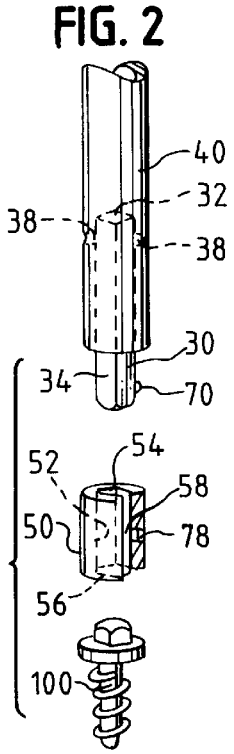
FIG. 2 is an exploded view of certain elements of the fastener-driving accessory and the fastener, as shown in FIG. 1.

Being elongate and defining an axis, the fastener-driving collar 50 has a passage 52 extending continuously through the collar 50 and defining two axially aligned sockets 54, 56, which open respectively at the opposite ends of the collar 50. The sockets 54, 56, are interchangeable to serve respectively as a stem-receiving socket and as a fastener-driving socket. As shown in FIGS. 1, 2, and 3, the socket 54 serves as the stem-receiving socket, while the socket 56 serves as the fastener-driving socket. The passage 52 has a hexagonal cross-section, which is similar to but larger than the hexagonal cross-section of the collar-mounting stem 30. Thus, each of the sockets 54, 56, has a hexagonal cross-section, which is similar to but larger than the hexagonal cross-section of the collar-mounting stem 30.

The collar-mounting portion 34 of the collar-mounting stem 30 is plugged partly and non-rotatably into whichever of the sockets 54, 56, serves as the stem-receiving socket, with a sliding fit and more than halfway through the passage 52, so as to cause the stem 30 and the collar 50 to be conjointly rotatable. As shown in FIG. 1, the collar-mounting portion 34 of the stem 30 is plugged partly and non-rotatably into the socket 54, more than halfway through the passage 52.

Figure 9:
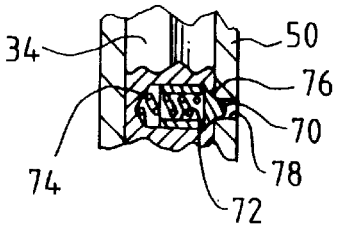
FIG. 9 is a fragmentary detail of a spring-loaded pintle, which exemplifies several that are employed in the preferred embodiment of the fastener-driving accessory, along with associated elements.

Preferably, as shown in FIG. 9, the collar-mounting stem 30 is secured to the fastener-driving collar 50 by a spring-biased pintle 70 mounted operatively in a radial socket 72 of the stem 30, biased in a radially outward direction by a coil spring 74 disposed in the socket 72, retained by a deformed margin 76 of the socket 72, and projecting in a radially outward direction, into a hole 78 in the collar 50. The hole 78 is centered approximately halfway between the opposite ends of the collar 50. The spring-biased pintle 70 secures the stem 30 to the collar 50 but enables the collar 50 to be readily removed, as when it is desired to interchange the collar 50 with the bit-mounting collar 60. The spring-biased pintle 70 is depressed by a pointed instrument (not shown) to remove the collar 50.

Figure 10:
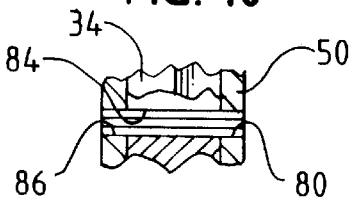
FIG. 10 is a fragmentary detail of a roll pin substitutable for the spring-loaded pintle, along with associated elements.
Figure 11:
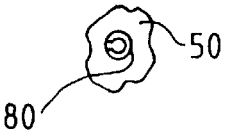
FIG. 11 is a fragmentary detail, which is taken from the right side of FIG. 10.

Alternatively, as shown in FIGS. 10 and 11, the collar-mounting stem 30 is secured removably to the fastener-driving collar 50 by a roll pin 80 driven through a suitably sized hole 82 in the collar 50, through a suitably sized cross-bore 84 in the stem 30, and through a suitably sized, diametrically opposed hole 86 in the collar 50. The roll pin 80 is driven by an impact tool (not shown) to remove the collar 50.

Figure 12:
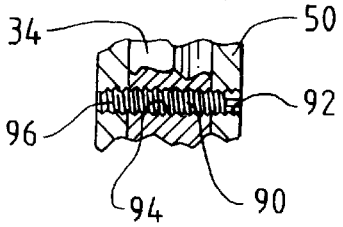
FIG. 12 is a fragmentary detail of a set screw substitutable for the spring-loaded pintle, along with associated elements.

Alternatively, as shown in FIG. 12, the collar-mounting stem 30 is secured removably to the fastener-driving collar 50 by a set screw 90 driven through a suitably sized, threaded hole 92 in the collar 50, through a suitably sized, unthreaded cross-bore 94 in the stem 30, and through a suitably sized, diametrically opposed, threaded hole 96 in the collar 50. The set screw 90 is unthreaded to remove the collar 50.

Whichever of the sockets 54, 56, serves as the fastener-driving socket is adapted to receive and coact with the head of a hex-head fastener of a known type, so as to drive the fastener rotatably when the fastener-driving accessory is driven rotatably by the tool chuck C. As shown in FIGS. 1, 2, and 3, the socket 56 serving as the fastener-driving socket receives and coacts with the head 102 of the hex-head fastener 100, so as to drive the fastener 100 rotatably when the fastener-driving accessory is driven rotatably by the tool chuck C.

When whichever of the sockets 54, 56, is employed initially to serve as the fastener-driving socket becomes worn so as to depart significantly from a hexagonal cross-section, the fastener-driving collar 50 is reversible so as to interchange the sockets 54, 56. Effectively, the useful life of the collar 50 is doubled, as compared to the useful life that the collar 50 would have if the collar 50 were to have a single socket.

Because the projecting end 34 of the collar-mounting stem 30 extends more than halfway through the passage 52 whenever the stem 30 is plugged partly and non-rotatably into whichever of the sockets 54, 56, serves as the stem-receiving socket, an intermediate portion 58 of the passage 52 (where the hole 78 is located) does not become worn but continues to have a hexagonal cross-section except for the hole 78, the holes 82, 86, or the holes 92, 96 (see FIGS. 10, 11, and 12) so that the collar 50 continues to be conjointly rotatable with the stem 30, even if whichever of the sockets 54, 56, serves as the fastener-driving socket has become worn.

Figure 4:
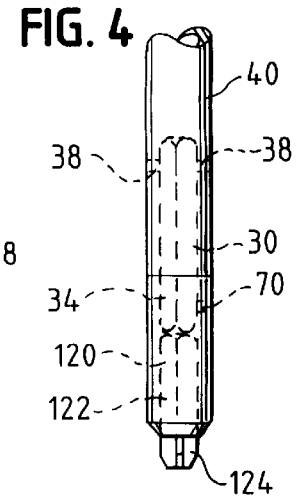
FIG. 4 is a fragmentary, perspective view of the fastener-driving accessory comprising a bit-mounting collar, which is interchangeable with the fastener-driving collar.
Figure 6:
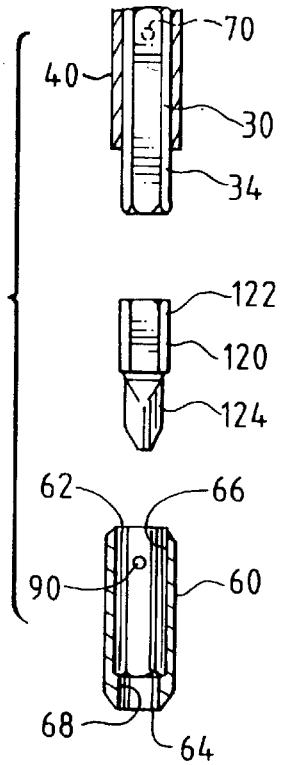
FIGS. 6, 7, and 8 are cross-sectional or axial views taken respectively along lines 6—6, 7—7, and 8—8 of FIG. 5, in the directions indicated by arrows.

Being elongate and defining an axis, the bit-mounting collar 60 has a stem-receiving end 62 and a bit-mounting end 64. The collar 60 defines a stem-receiving socket 66 opening at the stem-receiving end 62 and having a hexagonal cross-section, which is similar to but larger than the hexagonal cross-section of the collar-mounting stem 30. The collar 60 has an axial passage 68 extending between the bit-mounting end 64 and the socket 66 and having a circular cross-section with a cross-sectional area smaller than the cross-sectional area of the hexagonal cross-section of the socket 66. As shown in FIG. 4, the collar-mounting portion 34 of the collar-mounting stem 30 is plugged into the socket 66, which has sufficient axial length for such portion 34 to be axially spaced from the axial passage 68 when plugged into the socket 66.

Preferably, as shown in FIGS. 4 and 5, the bit-mounting collar 60 is secured to the collar-mounting stem 30 by the spring-biased pintle 70, which projects in a radially outward direction, into a hole 98 in the collar 60. The collar 60 can be alternatively secured to the stem 30, essentially as the collar 50 can be alternatively secured to the stem 30, by a roll pin (not shown) similar to the roll pin 80 shown in FIGS. 10 and 11 or by a set screw (not shown) similar to the set screw 90 shown in FIG. 12. The bit-mounting collar 60 is adapted to mount a fastener-driving bit of a known type, such as the fastener-driving bit 120.

Defining an axis, the fastener-driving bit 120 has a socket-fitting portion 122 and a fastener-driving portion 124, which has a fastener-driving tip 126. The socket-fitting portion 122 has a hexagonal cross-section conforming to the hexagonal cross-section of the collar-mounting stem 30. The fastener-driving portion 124 has an axial length greater than the axial length of the axial passage 68 of the bit-mounting collar 60 and has cross-sectional shapes varying along the axial length of such portion 124 but adapting such portion to extend through the passage 68.

When the fastener-driving bit 120 is mounted to the bit-mounting collar 60, the socket-fitting portion 122 is plugged slidably into the stem-receiving socket 66 of the bit-mounting collar 60 so that the fastener-driving portion 124 precedes the socket-fitting portion 122 and extends through the passage 68, whereby the fastener-driving tip 126 projects axially from the collar 60, before the collar-mounting portion 34 of the collar-mounting stem 30 is plugged into the socket 66.

Figure 7:
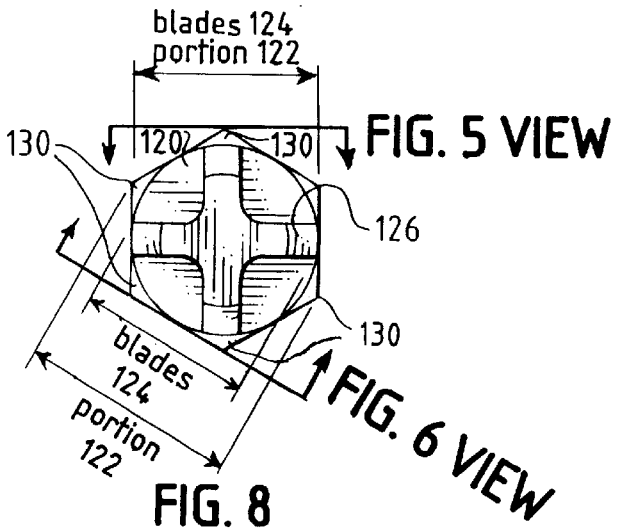
Figure 8:
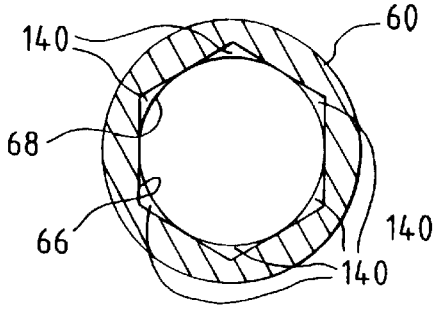

As shown in FIG. 7, the fastener-driving bit 120 defines six three-sided surfaces 130, each having two straight sides meeting at a 120° angle and a concave side conforming to a 120° circular arc. As shown in FIG. 8, the bit-mounting collar 60 defines six substantially similar, slightly larger surfaces 140. When the bit 120 is mounted to the collar 60, the three-sided surfaces 130 of the bit engage the slightly larger surfaces 140 of the collar 60, so as to prevent the bit 120 from being withdrawn from the collar 60, through the passage 68.

Various modifications can be made in the preferred embodiment, as illustrated and described, without departing from the scope and spirit of this invention.

What is claimed is:

1. A fastener driving kit useful with a rotary driving tool powered electrically or pneumatically, comprising:

a collar-mounting stem, said collar-mounting stem defining an axis and having a collar-mounting portion having a polygonal cross-section;

a fastener-driving collar, said fastener-driving collar defining an axis and two axially aligned sockets, each socket having a polygonal cross-section, which is larger than the polygonal cross-section of the collar-mounting portion, the cross-sections of the collar-mounting portion being of a given geometry and of the axially aligned sockets being of said given geometry, the axially aligned sockets being interchangeable to serve respectively as a stem-receiving socket and as a fastener-driving socket, the collar-mounting portion being adapted to be non-rotatably plugged into whichever socket serves as the stem-receiving socket so as to mount the fastener-driving collar coaxially on the collar-mounting stem, wherein said fastener-driving collar has two opposite ends and one continuous passage defining the axially aligned sockets, extending between the opposite ends, and having a polygonal cross-section conforming to the polygonal cross-sections of the axially aligned sockets;

means for securing the fastener-driving collar removably on the collar-mounting stem when the collar-mounting portion is plugged into whichever socket serves as the stem-receiving socket; and a bit-mounting collar, which is useful when the fastener-driving collar has been removed from the collar-mounting portion, the bit-mounting collar having two opposite ends, namely a stem-receiving end and a bit-mounting end, the bit-mounting collar defining a stem-receiving socket opening at the stem-receiving end and having a polygonal cross-section, which is larger than the polygonal cross-section of the collar-mounting portion of the collar-mounting stem, the bit-mounting collar having an axial passage extending between the bit-mounting end and the stem-receiving socket of the bit-mounting collar and having a circular cross-section with a cross-sectional area smaller than the cross-sectional area of the polygonal cross-section of the stem-receiving socket of the bit-mounting collar.

2. The fastener-driving kit of claim 1 combined with a fastener-driving bit defining an axis and having a socket-fitting portion, which has a polygonal cross-section conforming to the polygonal cross-section of the collar-mounting portion of the collar-mounting stem, and a fastener-driving portion, which has a fastener-driving tip, which has an axial length greater than the axial length of the axial passage and which has cross-sectional shapes adapting the fastener-driving portion to extend through the axial passage, and the fastener-driving bit being mountable to the bit-mounting collar with the socket-fitting portion fitting within the stem-receiving socket of the bit-mounting collar, between the collar-mounting portion and the axial passage, with the fastener-driving portion extending through the axial passage, and with the fastener-driving tip projecting axially from the bit-mounting collar.

3. The fastener-driving kit of claim 1 wherein the fastener-driving kit further comprises a tool-drivable stem and a quill connecting the tool-drivable and collar-mounting stems, whereby the collar-mounting stem is adapted to be rotable driven by the rotary driving tool, via the tool-drivable stem and the quill.

4. The fastener-driving kit of claim 3 wherein polygonal refers to hexagonal.

* * * * *

UNITED STATES PATENT AND TRADEMARK OFFICE

CERTIFICATE OF CORRECTION

PATENT NO. : 6,282,998 B1
DATED : September 4, 2001
INVENTOR(S) : John R. Beach

It is certified that error appears in the above-identified patent and that said Letters Patent is hereby corrected as shown below:

Column 8,
Line 6, "rotatable" should be -- rotatably --.

Signed and Sealed this

Fifth Day of March, 2002

*Attest:*

*Attesting Officer*

JAMES E. ROGAN
*Director of the United States Patent and Trademark Office*